United States Patent [19]

Curtin

[11] 4,268,271

[45] May 19, 1981

[54] REDUCTION OF THE FOULING POTENTIAL OF HIGH SODIUM COAL

[75] Inventor: Daniel J. Curtin, Danville, Calif.

[73] Assignee: Atlantic Richfield Company, Los Angeles, Calif.

[21] Appl. No.: 97,116

[22] Filed: Nov. 26, 1979

[51] Int. Cl.[3] ..... C10L 9/00

[52] U.S. Cl. ..... 44/1 R; 44/15 R; 209/659; 241/24

[58] Field of Search ..... 44/1 A, 1 SR, 1 R, 10 F; 209/659; 241/24

[56] References Cited

U.S. PATENT DOCUMENTS

| | | | |
|---|---|---|---|
| 914,248 | 3/1909 | Damon | 44/10 F |
| 1,153,182 | 9/1915 | Schniewind | 44/1 A |
| 1,420,165 | 6/1922 | Trent | 44/1 A |
| 2,049,814 | 8/1936 | Marquard | 241/24 X |
| 3,261,559 | 7/1966 | Yavorsky et al. | 241/24 |
| 3,599,885 | 8/1971 | Aldermann | 241/24 |
| 4,132,365 | 1/1979 | Verschuur | 241/24 X |

FOREIGN PATENT DOCUMENTS

| | | | |
|---|---|---|---|
| 375779 | 6/1932 | United Kingdom | 44/10 F |

*Primary Examiner*—Carl F. Dees
*Attorney, Agent, or Firm*—Ronnie D. Wilson

[57] ABSTRACT

A method whereby the potential of coal having a sodium content high enough to foul coal burning equipment is significantly reduced. The method comprises selectively crushing the coal and separating it according to particle size into low and high potential fouling fractions and recovering a sodium containing coal having a low potential for fouling coal-burning equipment.

8 Claims, No Drawings

REDUCTION OF THE FOULING POTENTIAL OF HIGH SODIUM COAL

BACKGROUND OF THE INVENTION

This invention relates to a method for decreasing the potential of sodium-containing coal to foul coal burning equipment. The presence of significant amounts of sodium in coal can cause many problems in the equipment utilized to burn same. For example, the use of a coal having a high sodium content as a metallurgical coal or as a premium boiler fuel can cause severe fouling problems in boilers.

Certain coal, such as that found in various deposits in the State of Illinois, has a low enough sulfur content that it may be used as a metallurgical coal or as a premium boiler fuel in power plants without the need for removing a portion of the sulfur therefrom. However, this coal does contain levels of sodium which give it a high probability of causing severe fouling problems in boiler or metallurgical coal applications.

Reduction of the fouling potential of such coal would provide a coal which meets allowable specifications for a typical steam coal. One method for reducing the fouling potential previously known is to reduce the sodium content thereof by leaching, but such leaching requires long contact times of 100 hours or more and large expensive pieces of equipment within which to conduct such leaching. Therefore, there is needed a fast, efficient method for decreasing the potential of sodium-containing coal to foul the equipment it is burned in.

SUMMARY OF THE INVENTION

Accordingly, it is an object of the present invention to provide a method for reducing the fouling of coal-burning equipment.

Another object is to provide a method for reducing the potential of sodium-containing coal to foul coal-burning equipment.

An additional objective of the present invention is to provide a method for reducing the potential of coal containing more than 0.15% by weight sodium to foul coal-burning equipment.

Other objects, aspects and several advantages of the present invention will become apparent upon a further reading of this disclosure and the appended claims.

It has been found that the objects of the present invention can be attained by a method which comprises the steps of selectively crushing the coal whereby the particles have a diameter of no more than about 4 inches, some of the particles being larger than 1 inch in diameter and others being less than 1 inch in diameter, separating the crushed coal into a low and high potential fouling fraction according to particle size, and recovering the coal having a low potential for fouling.

BRIEF DESCRIPTION OF PREFERRED EMBODIMENT

The presence of a significant amount of sodium in coal is detrimental to some of the equipment in which coal is normally burned. Such coal has a high probability of fouling this equipment by the formation of hard glass-like deposits on heater tubes which significantly reduce the amount of heat which can be transferred to these tubes. I have found that coal containing more than 0.15% by weight sodium has a high potential for such fouling. I have also found that such fouling is caused by the volatile sodium present in the coal. I have further discovered that coal particles of no larger than 1.0 inch in diameter resulting from selectively crushing the coal to about 4 inch size minus particles contribute more than their proportional share to the problems of equipment fouling by volatile sodium.

Accordingly, in the operation of the method of the present invention the coal should be selectively crushed in such a manner whereby only coal particles of no more than about 4 inches in diameter are obtained. Further, it is important that the coal contains some particles which have a diameter of greater than one inch and others with a diameter of less than one inch to enable one to separate the coal into high and low potential fouling fractions.

After the crushing operation of the method of the present invention, the separation of the coal into a low potential fouling fraction and a high potential fouling fraction should be done according to particle size. Coal particles having a diameter of less than 1.0 inch being in the high potential fouling fraction of the present invention and coal particles having a diameter of greater than 1.0 inch being in the low potential fouling fraction. This separation can easily be accomplished by conventional means, such as, wire mesh screens.

In one embodiment of the present invention, the coal, prior to separation, is crushed by so-called "impact crushing" to maximize the amount of coal particles having a diameter of more than 1.0 inch. By so selectively crushing the coal, one ensures that the high potential fouling fraction contains considerably less coal than the low potential fouling fraction. This is very important from an economic standpoint since the high potential fouling fraction may by put through more processing or simply dispensed with. Equipment sizes for any additional processing of the high potential fouling fraction can be reduced significantly by reducing the volume of coal in that fraction.

Of course it should be noted that in order to reduce the fouling potential of the coal, the high potential fouling fraction must contain at least about 25% by volume of the total amount of crushed coal. This amount of coal in the high potential fouling fraction is necessary to achieve a coal which upon burning does not evolve enough sodium to significantly foul the equipment being utilized. Therefore, a balance must be struck between how much coal is necessary in the high potential fouling fraction to achieve a low fouling coal for burning and the maximization of the low potential fouling fraction which reduces the additional processing needed for the high potential fouling fraction and the size of the equipment utilized therefor.

It is therefore preferred that crushing of the coal in preparation for separation into the fouling fractions of differing potentials be conducted in such a manner that the high potential fouling fraction (coal particles having a diameter less than 1.0 inch) constitute at least 25% of the particles in a given amount of the crushed coal in the method of the present invention. By so crushing, the amount of coal requiring further processing or disposal is controlled.

After separation of the coal by particle size, the high potential fouling fraction may be rejected and only used in those applications wherein a potential for fouling does not exist. As another alternative, the isolated high potential fouling fraction may be subjected to treatment with materials, such as, $SiO_2$ and/or $Al_2O_3$, to reduce the volatilization of the sodium.

In another embodiment of the present invention, the fouling fraction of high potential is subjected to sodium removal techniques to reduce the potential thereof for fouling. Subsequent to the sodium being removed from the high potential fouling fraction, this fraction is mixed with the low potential fouling fraction to yield a coal having a low potential for fouling.

Sodium removal can be achieved by any conventional technique from the high potential fouling fraction. The specific technique is a matter of local economic choice, although water leaching in many instances will prove to be the most inexpensive way. Since coal particles of 1.0 inch in diameter or less are very amenable to leaching because of their small size, relatively short leaching times of only one to twenty-four hours should not be uncommon and will render leaching much more economical than heretofore was possible.

Preferably, coal containing more than 0.15% by weight sodium can best be improved for utilization in coal-burning equipment, however, any sodium-containing coal will have its fouling potential reduced by the method of the present invention.

Having described certain preferred embodiments of the method of the present invention, it is pointed out that the embodiments described are by way of illustration rather than limitation and that many variations and modifications are possible within the scope of the present invention. It is anticipated that such variations and modifications may be considered obvious or desirable to those skilled in the art upon review of the foregoing description of the preferred embodiments and the appended example.

The method of the present invention, clearly provides economic advantages over the conventional wisdom of removing sodium from the total amount of coal being processed. By isolating the most offending portion of the coal and only subjecting that portion to further processing, significant savings in time and equipment costs are achievable.

The following example illustrates the fouling potential of various coal particle sizes by the amount of sodium volatilized upon burning and the utilization of the method of the present invention to reduce such fouling potential.

EXAMPLE

In order to substantiate the effect of the present invention on the ability of one to reduce the fouling potential of sodium-containing coal, the following two experimental runs were made using Illinois bituminous coal having a sodium content of 0.37% by weight.

In preparation for the two runs about seventy pounds of Illinois bituminous coal were crushed with a hammer to two inch minus particle size in order to simulate commercial impact crushing. About sixty-one percent by weight of the crushed coal had a particle size of greater than one inch in diameter and about thirty-nine percent by weight of the coal had a particle size of less than one inch in diameter. Utilizing conventional wire mesh screens the crushed coal was separated into the following seven fractions:

#1 2"×1½"
#2 1½"×1"
#3 1"×¾"
#4 ¾"×½"
#5 ½"×4 mesh
#6 4 mesh×28 mesh
#7 28 mesh×0

All seven of the fractions were then separately pulverized to minus 4 mesh particle size.

In the first of the two runs about 125 grams each of the fractions numbered 1, 5 and 6 were burned at a temperature of 2000° F. for a period of two hours, after a period of eight hours in which the temperature of the coal was gradually raised from room temperature to 2000° F. Subsequently, the amount of sodium remaining in each fraction was determined with the following results:

Fraction #1:90% of the sodium remained
Fraction #5:55% of the sodium remained
Fraction #6:30% of the sodium remained In the second of the two runs about 200 grams each of the fractions numbered 1, 2, 4, 5 and 6 were burned at a temperature of 2000° F. for a period of three hours, after a period of eight hours in which the temperature of the coal was gradually raised from room temperature to 2000° F. Subsequently, the amount of sodium remaining in each fraction was determined with the following results:

Fraction #1:70% of the sodium remained
Fraction #2:45% of the sodium remained
Fraction #4:11% of the sodium remained
Fraction #5:12% of the sodium remained
Fraction #6:22% of the sodium remained.

By examining the results of the set forth experimental runs, one can readily see that fractions containing particle sizes of less than one inch in diameter contribute a much larger share of evolved sodium than fractions containing particle sizes of more than about one inch in diameter. Therefore, these high potential fouling fractions should be isolated and dealt with accordingly to reduce the fouling of coal burning equipment.

Having thus described the invention I claim:

1. Method for reducing the potential of sodium-containing coal to foul coal-burning equipment, which comprises:

selectively crushing said coal so that the resulting particles thereof have a diameter of no more than about 4 inches, a portion of said particles have a diameter of more than 1 inch and another portion of said particles have a diameter of 1 inch or less, separating said crushed coal into a low potential fouling fraction containing primarily particles of more than 1 inch in diameter and a high potential fouling fraction containing primarily particles of 1 inch or less in diameter, and recovering the coal fraction having a low potential for fouling.

2. Method of claim 1 wherein at least 25% by volume of said particles resulting from said crushing step have a diameter of about 1 inch or less.

3. Method of claim 1 wherein said high potential fouling fraction contains coal particles no larger than about 1.0 inch in diameter.

4. Method of claim 1 wherein said sodium-containing coal contains more than 0.15% by weight sodium.

5. Method of claim 1 which includes the steps of removing sodium from said high potential fouling fraction and subsequently combining said fractions.

6. Method of claim 5 wherein said sodium in said high potential fouling fraction is removed via leaching.

7. Method of claim 6 wherein said leaching is accomplished with an aqueous leaching solution.

8. Method of claim 7 wherein said leaching solution is water.

* * * * *